US005283499A

United States Patent [19]

Adam et al.

[11] Patent Number: 5,283,499

[45] Date of Patent: Feb. 1, 1994

[54] IGNITER AND CABLE CONNECTOR ASSEMBLY

[75] Inventors: LeRoy B. Adam, Redding, Calif.; Steven J. Cannady, Greenville, S.C.; Darin W. Carr, Easley, S.C.; William B. Meeks, III, Greenville, S.C.; Michael A. Runge, Simpsonville, S.C.; Jan R. Schueren, Central, S.C.; Stephen W. Straub, Easley, S.C.

[73] Assignee: Cooper Industries, Inc., Houston, Tex.

[21] Appl. No.: 849,962

[22] Filed: Mar. 12, 1992

Related U.S. Application Data

[63] Continuation-in-part of Ser. No. 491,314, Mar. 9, 1990, abandoned.

[51] Int. Cl.[5] ..... H01T 13/04

[52] U.S. Cl. ..... 313/135; 313/136; 313/143; 313/144; 123/169 R; 439/126; 439/277; 439/370

[58] Field of Search ..... 313/135, 136, 143, 144, 313/145, 49, 50; 174/845; 60/39.827, 39.821; 123/143 C, 169 R, 169 P; 439/126, 345, 370, 277

[56] References Cited

U.S. PATENT DOCUMENTS

| | | | |
|---|---|---|---|
| 2,184,196 | 12/1939 | Nowosielski | 313/135 |
| 2,384,438 | 9/1945 | Bucy | 123/143 |
| 2,651,298 | 9/1953 | Brinson et al. | 439/126 |
| 3,229,032 | 1/1966 | Willis | 313/145 |
| 3,304,103 | 2/1967 | Wiltse | 174/845 |
| 4,249,103 | 2/1981 | Farrell | 313/135 |
| 4,553,927 | 11/1985 | Collins, Jr. | 313/135 |
| 4,978,309 | 12/1990 | Straub | 439/126 |

FOREIGN PATENT DOCUMENTS 860553 2/1961 United Kingdom .

*Primary Examiner*—Donald J. Yusko
*Assistant Examiner*—Nimesh Patel
*Attorney, Agent, or Firm*—MacMillan, Sobanski & Todd

[57] ABSTRACT

An improved igniter and cable connector assembly for turbine engines. An igniter mounting adapter is secured to the engine. The igniter slides into a hole through the adapter and is retained by an enlarged head on the igniter. An annular seal is positioned around a high voltage terminal on the igniter head and a terminal on the cable connector is positioned against the igniter terminal. The cable connector is secured to the adapter, for example, by either a clamp assembly or a coupling nut or a quick release connector. As the cable connector is secured to the adapter, the seal is compressed between the igniter and connector insulators and, optionally, the connector terminal is rotated and pressed against the igniter terminal to establish a reliable electrical contact. The connector and igniter terminals preferably have mating conical or spherical surfaces, one of which may be an annular segment to provide an increased electrical contact area.

36 Claims, 6 Drawing Sheets

IGNITER AND CABLE CONNECTOR ASSEMBLY

CROSS REFERENCE TO RELATED APPLICATION

This is a continuation in part of our copending patent application Ser. No. 07/491,314, filed Mar. 9, 1990 now abandoned.

TECHNICAL FIELD

This invention relates to gas engine igniters and more particularly to an improved igniter, to a cable connector assembly and adapter for securing the igniter to an engine, and to an improved terminal structure for an igniter and igniter cable connector.

BACKGROUND ART

Igniters for use in aircraft turbine engines are typically formed with a metal shell surrounding an insulator. The shell is threaded to engage a threaded igniter opening in the engine. A high voltage terminal is recessed well within a free end of the insulator. A mating high voltage cable connector has a projecting insulator which supports a terminal. The connector insulator extends well into the igniter insulator to establish a long flashover path between the high voltage terminals and the grounded igniter shell. This construction results in a large profile for prior art ignitor and cable connector assemblies. When one common prior art cable connector is secured to an igniter, the cable insulator projects into the igniter insulator and a spring in the cable connector presses the cable terminal against the igniter terminal to establish a high voltage connection. Typically, contact between the terminals takes place only at a point or over a small surface area. An appropriate annular seal is located between the igniter and the cable connector to keep contaminants from entering the space between the igniter and connector insulators. A separate spring may be provided in the connector to compress the seal against the igniter. Any contaminants entering the terminal region may result in igniter and/or cable failure due to flashover. Ideally, the seal will also prevent air from escaping from the space surrounding the terminals when the iqniter is operated at high altitude. As the air pressure across a gap decreases, the flashover voltage required to jump the gap also decreases.

There are many problems with the design of present state of the art igniters and igniter cable connectors. The large number of component parts in aviation engine igniters and igniter cable connectors results in a high manufacturing cost, a large profile and an excessive weight. There is difficulty in establishing and maintaining a good seal between the igniter and the connector and in maintaining a good electrical contact between the igniter and the connector terminals. Operating failures can occur at the seal and also at the contact point between the high voltage connector terminal and the igniter terminal. Any arcing between the terminals caused by poor surface contact will eventually lead to igniter or cable failure.

DISCLOSURE OF INVENTION

The present invention is directed to an improved igniter and to an improved igniter and cable connector assembly for turbine engines. An igniter adapter is, secured to an engine in alignment with an igniter hole in the engine. The adapter may be threaded into the igniter hole or it may be bolted to the engine to align with the igniter hole. The igniter slides through a hole in the adapter to position the spark gap on the igniter at the proper location in the engine combustion chamber. An enlarged diameter head on the igniter is retained by the adapter. An annular seal is positioned on the igniter head to encircle a high voltage terminal projecting from the igniter head. A spring loaded terminal on a cable connector extends through the center of the seal and is pressed against the igniter terminal when the cable connector is attached to the adapter. When the cable connector is secured to the adapter, the seal is compressed between the connector and igniter insulators. The cable connector may be secured to the adapter, for example, either by a hinged clamp which engages conical surfaces on the adapter and the cable connector or by a coupling nut on the cable connector which is threaded onto the adapter or by a quick connect mechanism on one of the connector or the adapter which releasably engages an annular groove on the other of the connector or the adapter.

As the connector is secured to the adapter, the igniter terminal is pushed in an axial direction against the force of a spring in the cable connector. At the same time, optional threads may be provided between the connector insulator and the terminal to cause the connector terminal to rotate about its axis to establish a good electrical contact with the igniter terminal. Preferably, the igniter and connector terminals are formed with mating conical or spherical surfaces, one of which is an annular segment having a void in the center to allow any surface contaminants between the contacting surfaces to escape. The terminal shape provides a wide line or surface contact extending around the axis of the terminals. This is an improvement over point or small area contact produced by many prior art terminal designs where flat or convex surfaces meet.

The improved igniter and cable connector assembly has several advantages over prior art assemblies. The annular seal provides improved flashover protection. The rotation of the connector terminal as it is pressed against the igniter terminal provides improved electrical contact. The igniter construction is less expensive to manufacture and weighs, less than prior art igniters since it required fewer parts, has a smaller profile and is simpler to manufacture. Further, the igniter adapter which is secured to the engine need not be removed from the engine or replaced when replacing the igniter.

Accordingly, it is an object of the invention to provide an improved igniter and cable connector assembly suitable for aviation engines.

Other objects and advantages of the invention will be apparent from the following detailed description and the accompanying drawings.

BEST MODE FOR CARRYING OUT THE INVENTION

Figure 2:
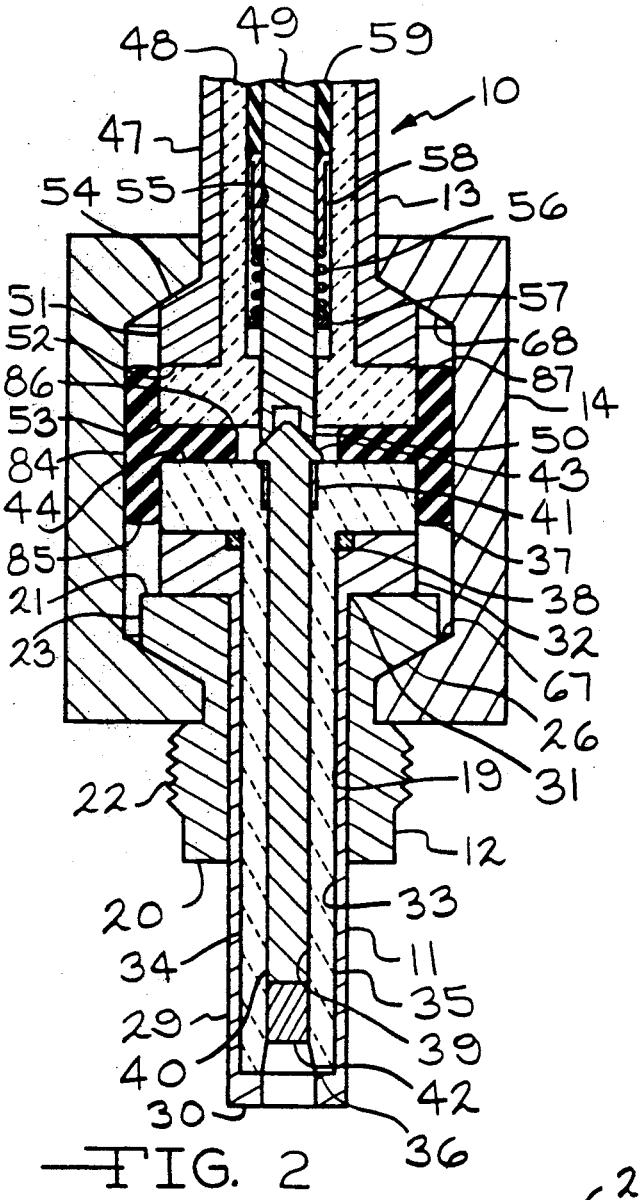
FIG. 2 is an enlarged vertical cross sectional view through the igniter and cable connector assembly of FIG. 1.
Figure 1:
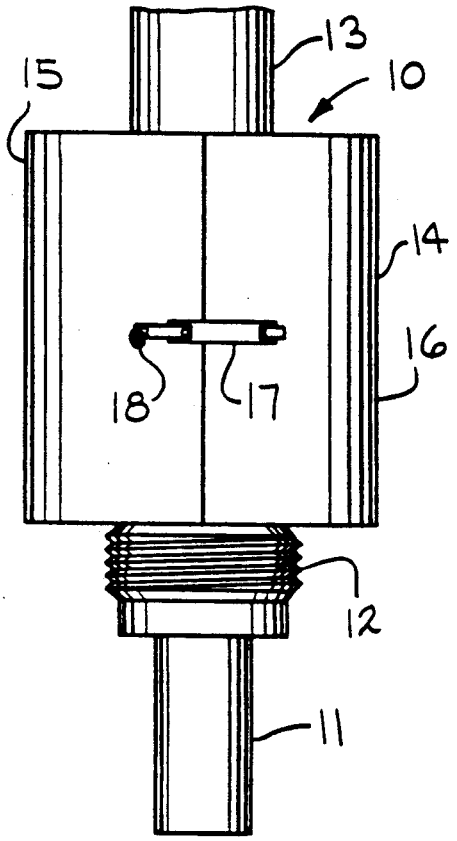
FIG. 1 is a side elevational view of an igniter and cable connector assembly according to a first embodiment of the invention.

Referring to FIGS. 1 and 2 of the drawings, an igniter and cable connector assembly 10 is illustrated according to a first embodiment of the invention. The assembly 10 includes an igniter 11, an engine mounting adapter 12 and a high voltage exciter cable connector 13. A clamp 14 secures the connector 13 to the adapter 12. The clamp 14 has two halves 15 and 16 which are secured together by a suitable latch 17. A wire or, split ring 18 prevent accidental opening of the latch 17.

Figure 3:
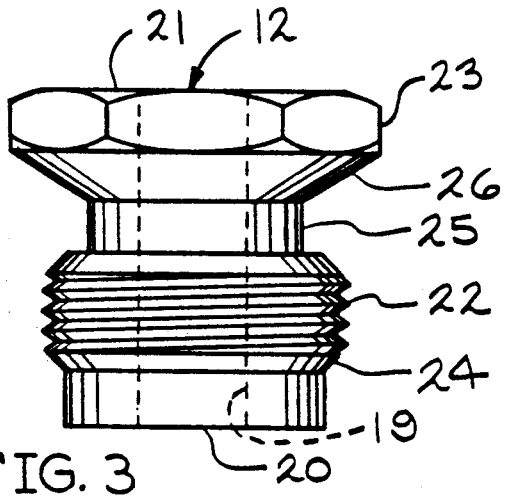
FIG. 3 is a side elevational view of the turbine engine mounting adapter from the assembly of FIG. 1.

The adapter 12 is shown in detail in FIGS. 2 and 3. The adapter 12 is generally tubular, having an axial opening 19 extending between a lower end 20 and an upper end 21. The adapter 12 has exterior threads 22 for securing the adapter to a threaded igniter opening in an engine (not shown). A hexagonal nut 23 is integrally formed on the exterior of the adapter 12 adjacent the upper end 21 for receiving a suitable wrench (not shown) when securing the adapter to or removing the adapter from an engine. Either a conical surface 24 below, the threads 22 or the lower adapter end 20 may be located to seat against a mating surface in the engine to form a gas tight seal. Or, a suitable gasket may be placed on the surface 24. Between the threads 22 and the nut 23, a reduced diameter groove 25 is formed around the adapter 12. The groove 25 has a conical upper surface 26 which faces downwardly and outwardly.

Figure 4:
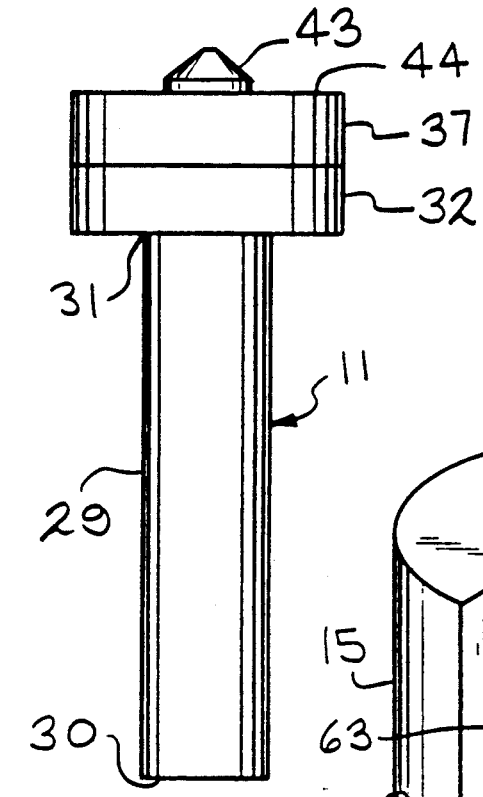
FIG. 4 is a side elevational view of the igniter from the assembly of FIG. 1.

Details of the igniter 11 are shown in FIGS. 2 and 4. The igniter 11 has a tubular shell or sheath 29 extending between a lower or first end 30 and an upper or second end 31. At the upper end 31, the metal forming the sheath 29 forms an enlarged diameter head 32. The sheath 29 has a diameter for a close sliding fit in the adapter opening 19, while the head 32 abuts against the upper adapter end 21. The sheath 29 has a stepped axial bore 33 for receiving a ceramic insulator 34. The insulator 34 has a tubular body portion 35 of a diameter for being received by the sheath bore 33. At a lower end 36, the insulator 34 is seated against the sheath end 30. The insulator 34 also has an enlarged diameter head 37 which abuts and overlays at least a portion of the sheath head 32. If desired, the sheath head 32 may wrap around at least a portion of the perimeter of the insulator head 37 to protect the. insulator head 37 from damage. A fused glass seal 38 is located between the heads 32 and 37 to retain the insulator 34 in the sheath 29 and to prevent combustion gases from leaking between the insulator 34 and the sheath 29.

The insulator 34 has an axial bore 39 in which a center electrode 40 is secured by a fused glass seal 41. The seal 41 also prevents combustion gases from leaking between the center electrode 40 and the insulator bore 39. The center electrode 40 has a lower end 42 which is spaced from the sheath end 30 to form a spark gap. The upper end of the center electrode 40 terminates at a high voltage igniter terminal 43. The terminal 43 projects above a top surface 44 on the insulator head 37. As illustrated, the terminal 43 may have an upwardly and outwardly directed conical shape. From the above description, it will be apparent to those skilled in the art that the igniter 11 is highly simplified over prior art turbine engine igniters. Typically, the prior art igniters include a large shell manufactured from multiple parts and several different insulator components. The simplified construction significantly reduces the manufacturing cost for the igniter 11.

FIG. 2 shows a cross section through an end of the igniter exciter cable connector 13. The connector 13 includes a shell 47, a ceramic insulator 48 and a high voltage electrode 49 which terminates at a terminal 50. The shell 47 has an enlarged diameter portion 51 terminating at an end 52 against which an enlarged diameter end 53 on the insulator 48 abuts. The enlarged diameter shell portion 51 has an upwardly and outwardly facing conical exterior surface 54 which is used to secure the connector 13 to the adapter 12, as will be discussed below. The electrode 49 is mounted in a bore 55 in the insulator 48 to reciprocate in an axial direction. A spring 56 located in the insulator bore 55 is compressed between a washer or pin 57 attached to the electrode 49 and a stationary sleeve 58. The spring 56 presses downwardly on the electrode 49 to extend the terminal 50 from the insulator bore 55. When the connector 13 is secured to the adapter 12, the spring 56 presses the connector terminal 50 against the igniter terminal 43. As the connector 13 and the igniter 11 are brought together, the electrode 49 moves in an axial direction into the insulator bore 55, sliding in a contact 59 connected to a high voltage wire in an exciter cable (not shown). As is discussed below, the electrode 49 preferably also is mounted in the insulator bore 55 to be slightly rotated as it is reciprocated in an axial direction.

Figure 5:
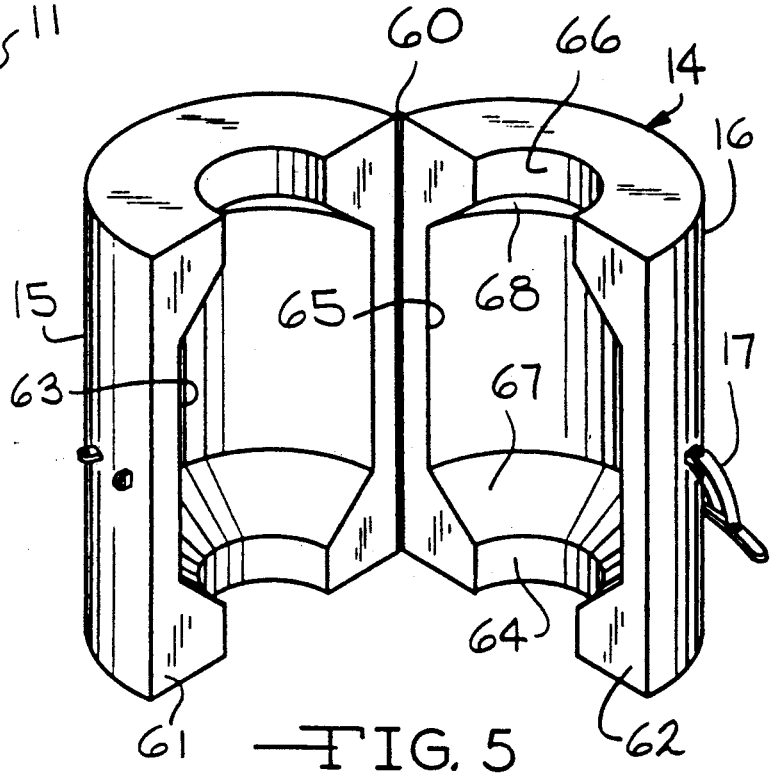
FIG. 5 is a perspective view showing the igniter and cable connector clamp assembly in an open position.

The clamp 14, which is shown in FIGS. 2 and 5, secures the cable connector 13 to the adapter 12. A hinge 60 connects one edge of the clamp halves 15 and 16 together to pivot between an open position as shown in FIG. 5 and a closed position as shown in FIG. 2. When the clamp 14 is closed, the latch 17 secures together open edges 61 and 62 of the clamp halves 15 and 16, respectively. The clamp 14 has a stepped axial bore 63 having a lower end 64 for fitting into the adapter groove 25, a central portion 65 for enclosing the head end on the igniter 11 and the enlarged end on the connector 13, and an upper end 66 for passing the connector shell 47. A conical surface 67 is located between the lower bore end 64 and the central bore portion 65 and a conical surface 68 is located between the central bore portion 65 and the upper bore end 66. The conical surface 67 is positioned and shaped to engage the conical adapter surface 26 and the conical surface 68 is positioned and shaped to engage the conical connector shell surface 54.

Figure 6:
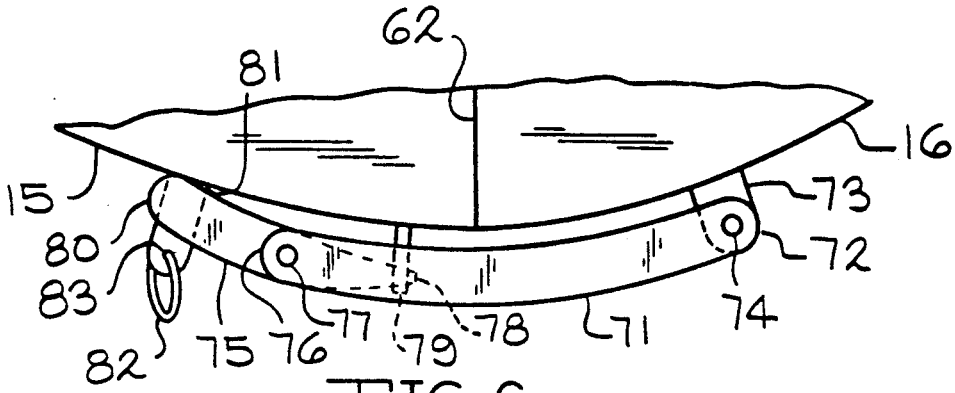
FIG. 6 is an enlarged fragmentary top plan view showing an exemplary latch for securing the clamp assembly of FIG. 5.

Details of an exemplary construction for the clamp latch 17 are shown in FIG. 6. The latch 17 has a first arm member 71 which is attached at an end 72 to a tab 73 on the clamp half 16 by a pivot pin 74. A second arm member 75 is pivotally attached near its center to an opposite end 76 of the member 71 by a pivot pin 77. The member 75 has a tapered end 78 which engages a bracket 79 on the clamp half 15. A free end 80 on the member 75 serves as a lever for opening and closing the latch 17. When the latch 17 is closed, a bracket 81 on the clamp half 15 extends through the member and a wire or a split ring 82 is passed through a hole 83 in the bracket 81 to prevent accidental opening of the latch 17. It will be appreciated by those skilled in the art that other types of latches may be used for releasably securing together the edges 61 and 62 of the clamp halves 15 and 16.

Referring again to FIG. 2, the igniter 11 is installed in an engine and the cable connector 13 is attached by first installing the adapter 12 in a threaded igniter opening in the engine. The igniter 11 is then slid into the adapter opening 19 until the sheath head 32 abuts the adapter end 21. Next, an annular resilient seal 84 is positioned around the head of the igniter 11. The seal 84 has a tubular lower end 85 which surrounds at least the periphery of the igniter insulator head 37 and may also surround the periphery of the sheath head 32. An integral flange 86 on the seal 84 extends radially inwardly over a portion of the top insulator surface 44 to surround the terminal 43. The seal 84 also has a tubular upper end 87 which receives and engages the periphery of at least the connector insulator end 53 and may also extend around a portion of the enlarged connector shell portion 51. The seal 84 is formed from a suitable high temperature resilient rubber like material. In the past, igniter connector seals have been constructed from a silicon rubber which is capable of withstanding operating temperatures of up to 450° F. However, according to a preferred embodiment of the invention, the seal is made from Kalrez manufactured and sold by E. I. DuPont de Nemours & Co. which can function at up ton 600° F.

After the seal 84 is positioned over the igniter insulator head 37, the connector 13 is positioned adjacent the igniter 11 with the insulator end 53 within the upper tubular seal end 87 and the connector terminal 50 contacting the igniter terminal 43. The open clamp 14 is positioned around the adapter 12 and connector 13 to extend into the adapter groove 25 and over the conical connector surface 54. As the clamp 14 is closed, the conical clamp surface 67 engages the conical adapter surface 26 and the conical clamp surface 68 engages the conical connector surface 54. The conical surfaces press the connector 13 axially toward the igniter 11 as the clamp 14 is closed. At the same time, the seal flange 86 is compressed between the connector insulator end 53 and the top surface 44 on the igniter insulator 37 to form a tight seal surrounding the terminals 43 and 50. The lower seal end 85 also is compressed between the periphery of the igniter insulator head 37 and the wall of the central portion 65 of the clamp bore 63 and the upper seal end 87 is compressed between the periphery of the connector insulator end 53 and the wall of the central portion 65 of the clamp bore 63. Thus, three separate annular sealing areas are produced when the clamp 14 is closed. The latch 17 is engaged to complete closure of the clamp 14 and the split ring 18 is installed to hold the clamp 17 closed.

Figure 7:
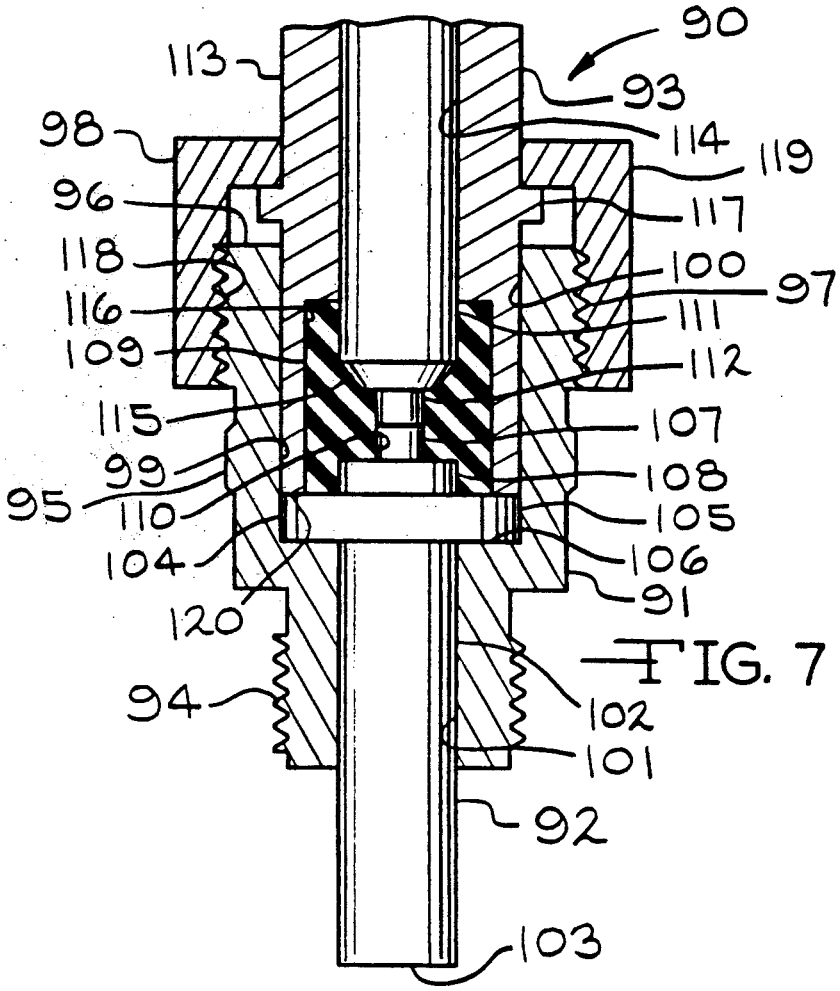
FIG. 7 is an enlarged fragmentary vertical cross sectional view through an igniter and cable connector assembly according to a modified embodiment of the invention.

Referring now to FIG. 7, an igniter and cable connector assembly 90 is illustrated according to a modified embodiment of the invention. The assembly 90 includes an adapter 91 for securing to an engine (not shown), an igniter 92 mounted in the adapter 91, and a connector 93 for attaching an exciter ignition cable (not shown) to the igniter 92. The adapter 91 has an externally threaded lower end 94 which is sized to engage a conventional threaded igniter opening in an engine. A hexagonal section 95 is formed on the adapter above the threaded end 94 to receive a suitable wrench when securing the adapter 91 to or removing it from the engine. Adjacent an upper end 96, the adapter 91 has an externally threaded section 97 for receiving a coupling nut 98 on the connector 93. The adapter 91 is tubular shaped and has a stepped axial bore 99 having a larger diameter upper section 100 and a smaller diameter lower section 101.

The igniter 92 may be of similar construction to the igniter 11 illustrated in FIGS. 2 and 4. The igniter 92 has a body 102 having an exterior diameter for sliding into and closely engaging the walls of the lower adapter bore section 101. At a lower end 103, the igniter defines a recessed spark gap. At an opposite upper end, the igniter 92 has an enlarged diameter head 104 including a flange 105 which abuts an end wall 106 of the adapter bore section 100 to retain the igniter 92 in the adapter bore 99.- A high voltage terminal 107 projects above an insulator section 108 which overlays at least a portion of the flange 105.

An annular seal 109 is positioned over the igniter head 104. The seal 109 has a stepped bore 110 which conforms to at least the insulator section 108 and surrounds the terminal 107. The seal bore 110 also conforms to a lower end 115 of an insulator 111 and to a high voltage terminal 112 on the connector 93. The seal may be made from any suitable resilient material which will resist the operating temperatures present between the igniter 92 and the connector 93, such as a silicon rubber or, preferably, Kalrez.

The connector 93 has a tubular shell 113 with a bore 114 in which the insulator 111 is mounted. Either the insulator 111 and the terminal 112 are mounted to reciprocate together in an axial direction relative to the shell 113 or, preferably, the terminal 112 is mounted to axially reciprocate in the insulator 111, as is known in the prior art. As is discussed below, the terminal 112 is preferably mounted to rotate as it reciprocates in the insulator 111. Adjacent the lower end 115 of the insulator 111, the shell bore 114 has an enlarged diameter section 116. The seal 109 is compressed to fill the chamber between the shell bore section 116, the insulator end 115, the terminals 108 and 112 and the igniter head 104.

The connector shell 113 has an enlarged diameter radial flange 117 which retains the coupling nut 98. The coupling nut 98 has an internally threaded section 118 which engages the threaded section 97 on the adapter 91. An exterior surface 119 on the coupling nut 98 may be shaped to receive a wrench (not shown) for securing the coupling nut 98 to and removing it from the adapter 91. When the connector 93 is inserted into the adapter 91 and the coupling nut 98 is tightened, an end 120 on the shell 113 presses against the igniter flange 105 to tightly hold the igniter 92 in the adapter 91 and the connector terminal 112 is pressed firmly against the igniter terminal 108.

Figure 8:
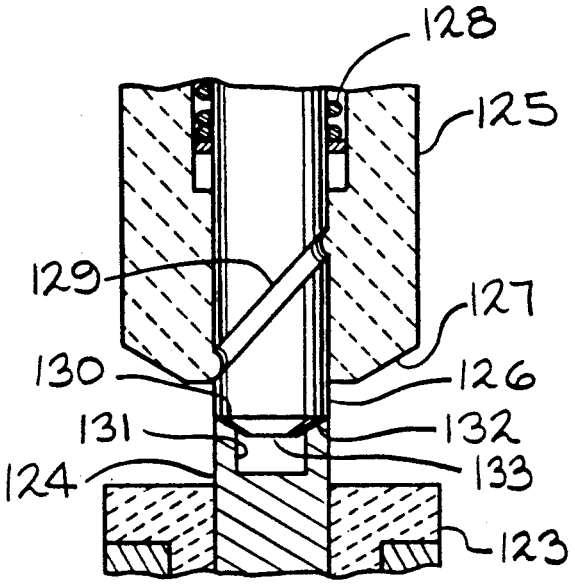
FIG. 8 is an enlarged fragmentary cross sectional view showing details of the igniter and cable connector terminals according to a modified embodiment of the invention.
Figure 9:
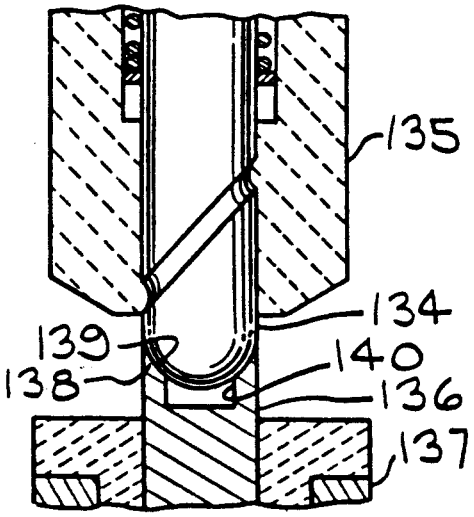
FIG. 9 is an enlarged fragmentary cross sectional view showing details of the igniter and cable connector terminals according to a further modified embodiment of the invention.

FIG. 2 illustrates an igniter 11 having a terminal 43 in the shape of an upwardly and outwardly facing cone and a connector having a terminal 50 with an end surface in the form of a conical segment which makes a ring contact around the axis of the igniter terminal 43. FIGS. 8 and 9 illustrate additional preferred embodiments of the configuration of the igniter and connector terminals. FIG. 8 shows a fragmentary portion of an igniter 123 having a terminal 124 and a fragmentary portion of a connector 125 having a terminal 126. The connector terminal 126 is mounted to reciprocate in an insulator 127 against the force of a spring 128. According to one embodiment of the invention, one or more mating threads 129 are formed between the insulator 127 and the terminal 126. The threads 129 are coarsely formed to impart a limited amount of rotation to the terminal 126 as it is reciprocated in the insulator 127. This rotation produces a wiping action between the terminals 126 and 124 as the connector 125 is secured to the engine adapter and the terminal 126 is pressed into the insulator 127. The wiping action establishes a more positive electrical contact between the terminals 124 and 126. Only slight rotation of the terminal 126 is effective, for example, a rotation of less than 90° is effective. It should be appreciated that the terminal 50 in FIG. 2 may be mounted to rotate in a similar manner as it is reciprocated.

The mating surfaces of the terminals 124 and 126 are preferably either conical, as shown in FIG. 8, or spherical. The igniter terminal 124 has a contact surface 130 in the form of an upwardly and inwardly facing conical segment with an open center 131. The connector terminal 126 has a contact surface 132 in the form of a downwardly and outwardly facing conical segment and has a flat center 133. When the terminals 124 and 126 are pressed together, the surfaces 130 and 132 abut around the axis of the igniter 123 and connector 125 to form a continuous contact around a conical segment defined by the surface 130. Rotation of the connector terminal 126 as contact is established between the terminals 124 and 126 causes any minor surface contaminants such as small particles of dirt either to escape into the center opening 131 or to move outwardly from the contacting surfaces. This effectively provides a greater and more positive electrical contact area than is achieved in prior art igniter and cable connector assemblies. In many prior art connectors, contact is achieved at only a point or over a small area. Surface dirt may prevent direct surface contact, which will initially result in small arcing between the adjacent surfaces. Any such arcing may lead to eventual failure of the igniter.

FIG. 9 shows a further modification in which a terminal 134 is mounted to axially reciprocate and to rotate in a connector insulator 135 and a terminal 136 is mounted on an igniter 137. The connector terminal 134 is provided with a convex spherical end surface 138 which contacts a concave spherical end surface 139 on the igniter terminal 136. An opening 140 is provided in the center of the concave igniter terminal surface 139 to allow any surface dirt and contaminants to escape from the contact area. The terminals 134 and 136 are shaped to obtain electrical contact over a spherical segment extending around the axes of the igniter 137 and the connector 135.

Figure 10:
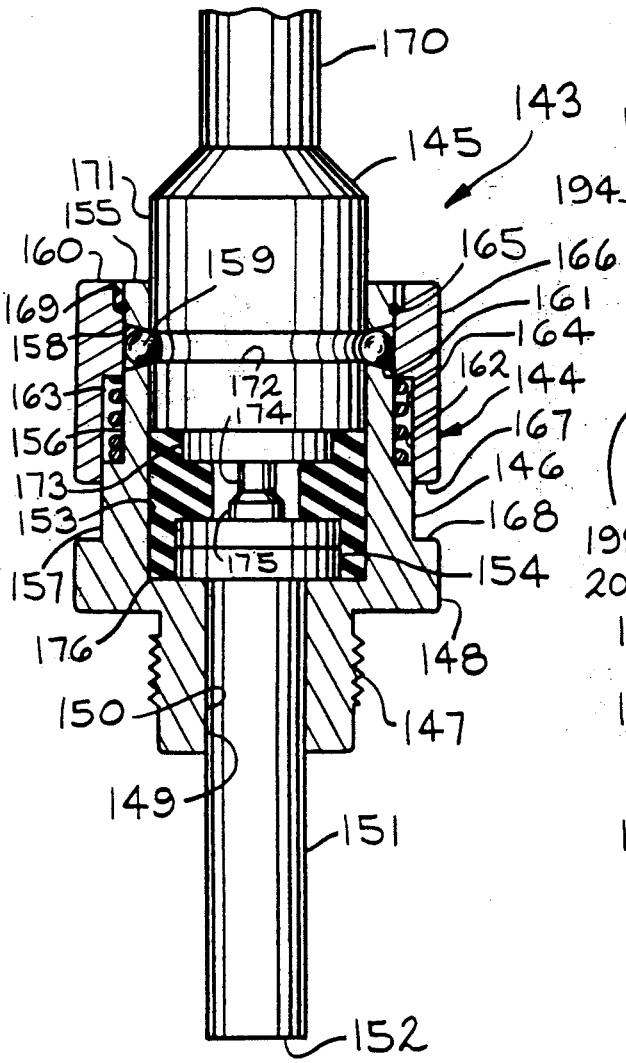
FIG. 10 is an enlarged fragmentary cross sectional view through an igniter and cable connector assembly according to a further modified embodiment of the invention.

FIG. 10 is an enlarged fragmentary cross sectional view showing a further modified embodiment of an igniter and cable connector assembly 143 according to the invention. In the assembly 143, a quick release mechanism 144 is used to secure an exciter cable connector 145 to an adapter 146. The quick release mechanism 144 may be located either on the connector 145 or on the adapter 146, although it is shown on the adapter 146 in FIG. 10. The quick release mechanism 144 can be of a construction similar to quick release hose connectors and permits easy attachment and removal of the connector 145 without the need for tools. The quick release mechanism 144 is strong and reliable.

The adapter 146 has an externally threaded lower end 147 adapted to engage a threaded igniter opening in an engine (not shown). A hexagonal section 148 is formed above the threaded end 147 for engagement with a suitable wrench when installing the adapter 146 in or when removing the adapter 146 from an engine. A stepped bore 149 extends axially through the adapter 146. The bore 149 has a smaller diameter lower end 150 for passing the body 151 of an igniter 152 and an enlarged diameter upper end 153 for retaining a head end 154 of the igniter 152.

Adjacent an upper end 155, the adapter 146 has a predetermined diameter exterior section 156. The adapter 146 has a slightly larger diameter exterior section 157 between the exterior section 156 and the hexagonal section 148. At least three tapered holes 158 are formed in the adapter section 156 to lie in a plane perpendicular to the axis of the upper bore end 153. A ball 159 is located in each hole 158. Each ball 159 has a diameter greater than the wall thickness of the adapter section 156. The balls 159 and holes 158 are sized such that the balls 159 may extend through the holes 158 into the bore end 153 while they are restrained from passing totally through the holes 158 into the bore end 153. A spring loaded tubular sleeve 160 is positioned to slide on the adapter 146. The sleeve 160 has an interior section 161 which slides on the exterior adapter section 156 and an interior section 162 which slides on the exterior adapter section 157. A spring 163 is located in a chamber 164 between the sleeve section 162 and the adapter section 156. The spring 163 presses the sleeve 160 in an upward axial direction against a retainer ring 165 which engages the adapter exterior section 156 between the tapered holes 158 and the adapter end 155. While the sleeve 160 is held in its normal up position against the retainer ring 165, the interior section 161 of the sleeve 160 is positioned over the balls 159 to hold the balls 159 in a position wherein they extend into the adapter bore section 153. The sleeve 160 may be moved downwardly in an axial direction against the spring 163 by manually grasping and pushing on a knurled exterior surface 166 until a sleeve end 167 abuts a stop 168 on the adapter 146. In this position, an enlarged interior diameter area 169 in the sleeve 160 permits the balls 159 to retract from the bore section 153 into the holes 158.

The connector 145 is attached to a free end of a high voltage cable 170 from an exciter (not shown). The connector 145 includes a shell 171 having an exterior diameter for sliding in an axial direction into and for closely engaging the walls of the upper adapter bore section 153. An annular groove 172 is formed in the shell 171 at a location for receiving the balls 159 when the connector 145 is secured to the adapter 146. The connector 145 is secured to the adapter 146 by moving the sleeve 160 against the spring 163 until the balls 159 can retract from the upper bore adapter end 153, inserting the connector 145 into the upper adapter bore end 153 and releasing the sleeve 160 to force the balls 159 into the connector groove 172. The balls 159 retain the connector 145 in the adapter 146 until the sleeve 160 is moved to allow the balls 159 to retract from the groove 172.

The remaining internal construction of the connector 145 may be similar to the construction of the connector 93 described above. The connector 145 has an internal insulator 173 which mounts a high voltage terminal 174 for axial and preferably also for rotational movement when the connector 145 is secured to the adapter 146. The connector terminal 174 is pressed against a center electrode terminal 175 projecting from the igniter head 154. The terminals 174 and 175 preferably have a construction as shown for the terminals in any of FIGS. 2, 8 or 9. A resilient annular seal 176 extends around the terminals 174 and 175 and is compressed between the igniter head 154 and the connector insulator 173, between the igniter head 154 and the adapter bore end 153, and between the connector insulator 173 and the adapter bore end 153.

Figure 11:
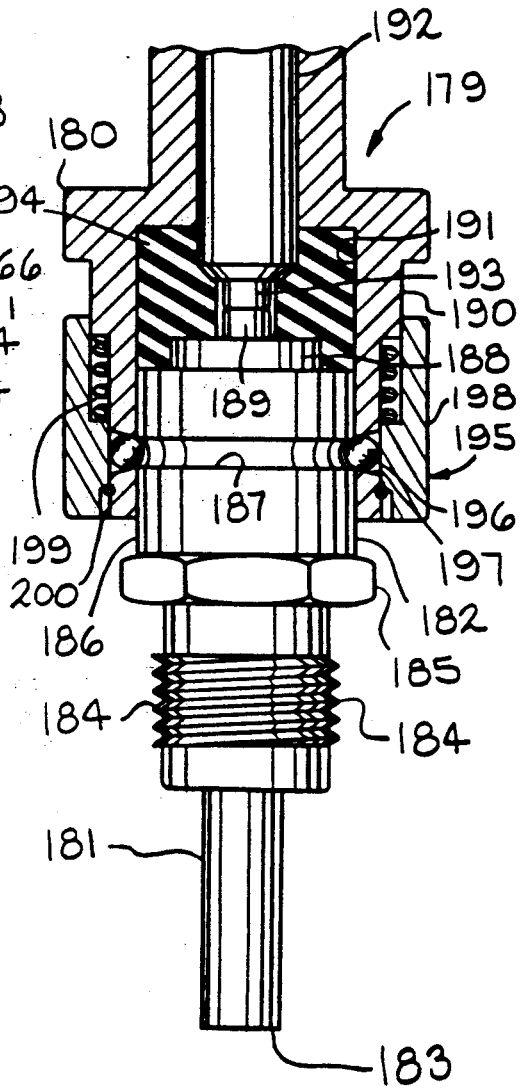
FIG. 11 is an enlarged fragmentary cross sectional view through an igniter and cable connector assembly according to a still further modified embodiment of the invention.

FIG. 11 shows an igniter and cable connector assembly 179 according to a further embodiment of the invention including a quick release exciter cable connector 180 secured directly to an igniter 181. No adapter is used with the assembly 179. The igniter 181 has a shell 182 forming a lower end 183 for projecting into an engine combustion chamber, a threaded section 184 for engaging a threaded igniter opening in the engine and a hexagonal section 185 for engagement by a wrench (not shown). Above the hexagonal section 185, the igniter shell 182 has an enlarged diameter upper section 186 which includes an annular groove 187. An insulator 188 and a center electrode terminal 189 extend coaxially from the upper section 186.

The connector 180 includes a shell 190 having a bore 191 sized to slide coaxially over and closely engaging the upper section 186 of the igniter shell 182. An insulator 192 mounting a high voltage terminal 193 is mounted in the shell 182 for contacting the igniter terminal 189 when the connector 180 is secured to the igniter 181. A resilient annular seal 194 fills the chamber around the terminals 189 and 193 between the connector 180 and the igniter 181. The connector 180 has a quick release mechanism 195 which functions in a manner identical to the quick release mechanism 144 illustrated in FIG. 10. The mechanism includes a plurality of balls 196 positioned in tapered holes 197 in the connector shell 190 and a sleeve 198 for retaining the balls in the holes 197. The balls are positioned to engage the igniter shell groove 187 when the connector 180 is attached to the igniter 181. The sleeve 198 is normally maintained in a locked position by a spring 199 which pushes the sleeve 198 against a retainer ring 200. Manually moving the sleeve 198 against the spring 199 allows the balls to move into the holes 197 to install the connector 180 on and to remove the connector 180 from the igniter 181.

Figure 12:
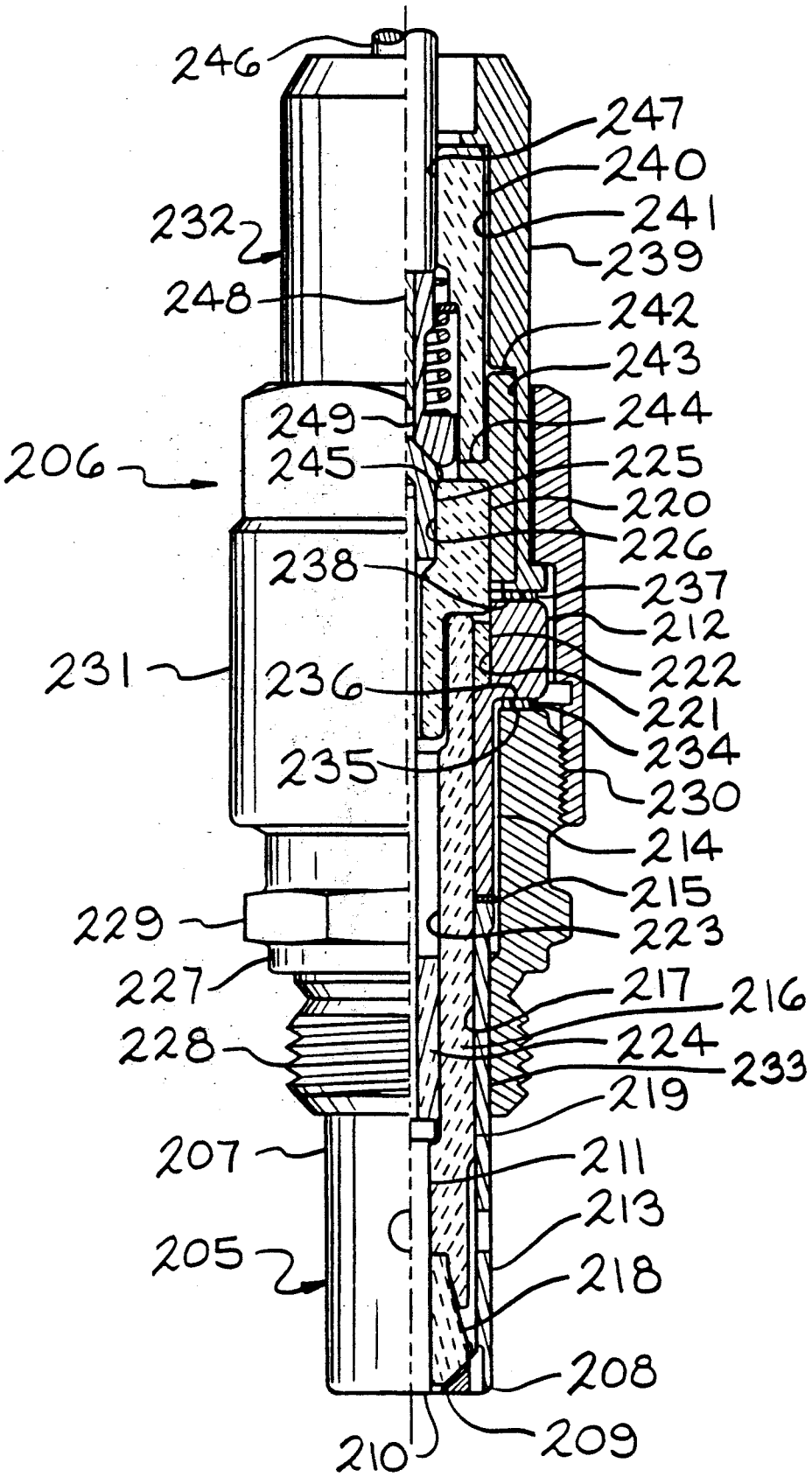
FIG. 12 is a partially broken away enlarged side view through an igniter and cable connector assembly according to a further modified embodiment of the invention.

Referring to FIG. 12, a modified embodiment of an improved igniter 205 and an igniter and cable connector assembly 206 are shown. The igniter 205 includes a tubular shell 207 having an end 208 defining an integral ground electrode 209 which forms an annular spark gap with an end 210 of a center electrode 211. The shell 207 has an enlarged diameter second end 212. The shell may be formed from a single piece of metal or it may be formed from two sections 213 and 214 secured together by a weld 215 or other suitable joining method. By forming the shell from two sections, only the section 213 which is exposed to the engine combustion chamber need be formed from a higher cost material which can withstand the operating temperatures and combustion gases, while the section 214 may be formed from a lower cost material.

An insulator assembly 216 is mounted in an axial bore 217 through the shell 207. The illustrated insulator assembly 216 consists of a semiconductor body 218 extending between the center electrode end 21 and the ground electrode 209 at the spark gap, a generally tubular central body 219 and an upper portion 220 which may form an enlarged diameter head for said insulator assembly 216. However, other known insulator constructions, such as a one piece insulator, may be used when desirable. An annular space 221 between the central insulator body 219 and the shell end 212 receives a glass seal 222 which bonds the central body 219 to the shell 207 to form a gas tight seal about the axis of the igniter 205. The center electrode 211 is mounted in a stepped bore 223 through the insulator assembly 216. A fused glass seal 224 forms a gas tight seal between the central insulator body 219 and the center electrode 211 about the axis of the igniter 205. After the seals 222 and 224 are fired, the upper insulator portion 220 is cemented or otherwise secured to the central insulator body 219 and a high voltage terminal 225 is cemented or otherwise secured into an axial opening 226 in the upper insulator portion 220. The terminal 225 telescopes onto and makes electrical contact with the center electrode 211. The upper insulator portion 220 may extend over at least a portion of the shell 207 in an axial direction so that it has a greater outer diameter than the minimum diameter of the shell bore 217.

The igniter and cable connector assembly 206 includes an adapter 227 which is similar in design to the adapter 91 of FIG. 7. The adapter 227 is generally tubular and has an externally threaded end 228 for engaging an igniter opening in an engine (not shown). A hexagonal section 229 is formed adjacent the threaded end 228 for receiving a wrench when securing the adapter 227 to or removing it from the engine. A second externally threaded end 230 receives a coupling nut 231 on a high voltage cable connector 232. The adapter 227 has an axial opening 233 for receiving the igniter 205. A resilient annular seal 234 is positioned adjacent a side 235 of the enlarged shell end 212 and the igniter 205 is slid axially into the adapter opening 233 until the seal 234 is clamped between the shell side 235 and an annular end surface 236 on the adapter 227. A second resilient annular seal 237 is positioned between an end flange 238 on a connector housing 239 and the shell end 212. The flange 238 retains the coupling nut 231 on the connector housing 239. When the coupling nut 231 is secured to the threaded adapter end 228 and tightened, the seal 234 is compressed to prevent combustion gas leakage between the igniter 205 and the adapter 227. The seal 237 also is compressed between the igniter 205 and the connector housing 239.

The connector 232 includes a tubular insulator 240 mounted in a stepped axial opening 241 through the housing 239. A resilient annular seal 242 is positioned within an enlarged diameter portion 243 of the opening 241. The seal 242 has an inwardly directed radial flange 244 which abuts an end 245 of the insulator 240. The seal flange 244 retains the insulator 240 in the housing 239. When the connector 232 is secured to the adapter 205, the seal flange 244 is clamped between the connector insulator 240 and the upper portion 220 of the igniter insulator 216 to prevent dirt and moisture from entering the region adjacent the igniter terminal 225.

A high voltage electrical cable 246 extends from an external power source (not shown) into the connector 232. The cable 246 passes coaxially into an axial opening 247 through the connector insulator 240 and a conductor 248 in the cable 246 is secured to a connector terminal 249. A spring 250 is mounted in the insulator opening 247 to urge the terminal 249 into electrical contact with the igniter terminal 225.

Figure 13:
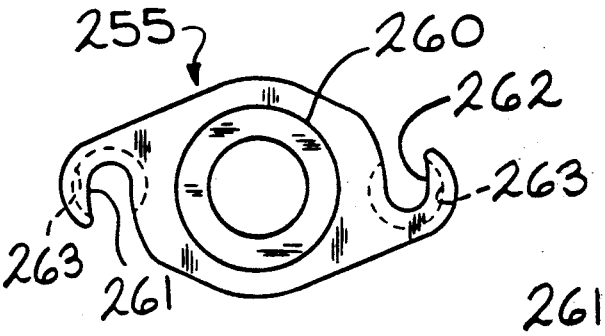
FIG. 13 is a bottom plan view of a modified turbine engine adapter according to a further embodiment of the invention.
Figure 14:
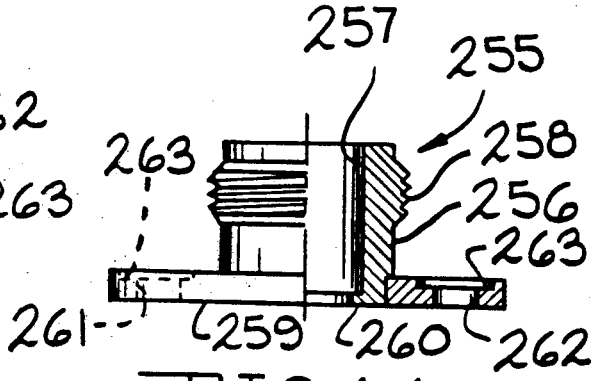
FIG. 14 is a partially broken away side view taken of the adapter of FIG. 13.

FIGS. 13 and 14 illustrate a modified adapter 255 for securing to an engine. The adapter 255 has a tubular section 256 defining an axial opening 257 for receiving an igniter, such as the igniter 205 of FIG. 12. The tubular section 256 has an externally threaded end 258 for securing a high voltage cable connector, such as the connector 232 of FIG. 12. A flange 259 is secured to an opposite end 260 of the tubular section 256. The flange 259 has two oppositely directed notches 261 and 262 for receiving bolts which secure the adapter 255 to an engine. Preferably, the notches 261 and 262 have counterbores 263 to retain the heads of bolts. It should be noted that the open notches 261 and 262 may be replaced with closed sided bores.

Figure 15:
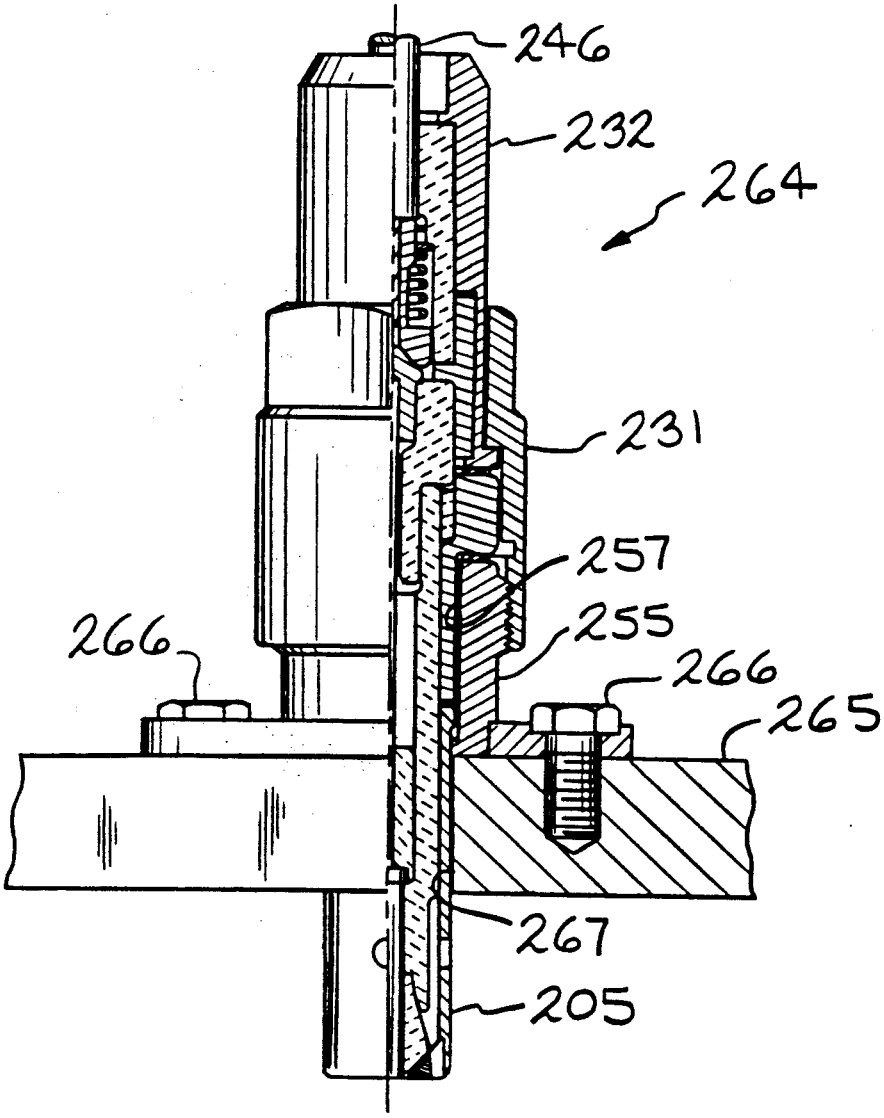
FIG. 15 is a partially broken away enlarged fragmentary view through an igniter and cable connector assembly secured to the adapter of FIGS. 13 and 14 according to a further modified embodiment of the invention.

FIG. 15 illustrates an igniter and cable connector assembly 264 secured to a portion of an engine 265 (shown in fragmentary). The adapter 255 (of FIGS. 13 and 14) is secured to the engine 265 by means of two bolts 266. The adapter 255 is secured to the engine 265 with the adapter opening 257 in axial alignment with an igniter opening 267 in the engine 265. The igniter 205 (of FIG. 12) is inserted into the adapter opening 257 and then the connector 232 (of FIG. 12) is secured to the adapter 255 by means of the coupling nut 231 to complete attachment of the igniter to the engine 265 and establishing an electrical connection to the igniter 205.

The above described embodiments of an igniter and cable connector assembly have several advantages over prior art assemblies. The assemblies are less expensive to manufacture, have a smaller profile and may weigh less than prior art assemblies. Except for the igniter 181, there are no threaded connections on the igniter. Once the adapter is attached to the engine, the igniter may be inserted and later replaced without removing or changing the adapter. For the igniter and cable connector assemblies illustrated in FIGS. 1, 2 and 10, no tools are required to replace the igniter. In the past, the threads on the igniters were silver plated to prevent seizure. No silver plating is required on the igniters of FIGS. 1, 2, 10, 12 and 15 since there are no threads on the igniters. Further, the construction of the seal between the igniter and the connector is more simplified and more effective at preventing flashover than seals in many prior art assemblies.

The design of the igniter also has several advantages over prior art igniters. The insulator and sheath designs are considerably simplified over prior art igniters. In the igniter embodiments illustrated in FIGS. 2, 4, 7, 10 and 11, no internal tamped seals are required between a shell and the insulator or between the insulator and the center electrode. Nor is seal reaming required since there are no tamped seals. The igniter 205 of FIGS. 12 and 15 does have conventional fused glass seals. The ceramic insulator may be a simple one piece insulator or it may be of multiple parts as shown in FIGS. 12 and 15. Further, assembly gaging of the various components may not be required as in the past.

It will be appreciated by those skilled in the art that various modifications and changes may be made in the above described preferred embodiments of the igniter and exciter cable connector assembly and in the design of the igniter without departing from the spirit and the scope of the following claims. For example, it will be appreciated that the conical and spherical terminal constructions shown in FIGS. 2, 8 and 9 and the means for rotating the connector terminals shown in FIGS. 8 and 9 may be readily adapted to other igniter and connector designs. The quick release cable connectors shown in FIGS. 10 and 11 also may be adapted to other connector and igniter designs.

We claim:

1. An igniter and cable connector assembly for use with an engine comprising, in combination, an adapter having an axial opening for receiving an end of an igniter, means for securing said adapter to an engine with said axial adapter opening aligned with an igniter opening in the engine, an igniter having a first end for extending through said adapter opening and having a second end retained by said adapter, a high voltage terminal mounted on said second igniter end and connected through a center electrode to a spark gap at said first end, an annular seal surrounding said igniter. terminal, a high voltage cable connector, a terminal on said cable connector, and means for securing said cable connector to said adapter with said connector terminal extending through the center of said seal and pressing against said igniter terminal, said securing means compressing said seal between said igniter and said connector.

2. An igniter and cable connector assembly, as set forth in claim 1, wherein said igniter has a tubular metal shell extending from said first end to said second end, said shell having substantially the diameter of said adapter opening, and said shell terminating at a head at said second end, said head having a diameter greater than said adapter opening.

3. An igniter and cable connector assembly, as set forth in claim 2, wherein said igniter further has a tubular insulator mounted coaxially in said tubular shell, said igniter insulator having a head at said second shell end, a center electrode mounted in a bore through said tubular insulator to form one side of a spark gap at said first shell end, and wherein said igniter terminal projects from said igniter insulator at said insulator head.

4. An igniter and cable connector assembly, as set forth in claim 3, wherein said connector includes a tubular insulator having an end, said connector end supporting said connector terminal, and wherein said seal is compressed between said connector insulator end and said igniter insulator head when said connector is secured to said adapter.

5. An igniter and cable connector assembly, as set forth in claim 4, wherein said connector includes a metal shell, and wherein said means for securing said connector to said adapter includes external threads on said adapter and a coupling nut retained on said connector shell and having internal threads for engaging said external adapter threads.

6. An igniter and cable connector assembly, as set forth in claim 5, wherein said seal is further compressed between said igniter insulator and said adapter and between said connector insulator and said adapter when said coupling nut engages said adapter.

7. An igniter and cable connector assembly, as set forth in claim 6, wherein said connector includes spring means mounting said connector terminal for axial movement between first and second positions, said connector terminal moving from said first position toward said second position when said connector is secured to said adapter, and means for causing said connector terminal to rotate about its axis as it moves between said first and second positions.

8. An igniter and cable connector assembly, as set forth in claim 7, wherein said connector terminal and said igniter terminal have mating conical surfaces, and wherein at least one of said conical surfaces is a conical segment.

9. An igniter and cable connector assembly, as set forth in claim 7, wherein said connector terminal and said igniter terminal have mating spherical surfaces, and wherein at least one of said spherical surfaces is a spherical segment.

10. An igniter and cable connector assembly, as set forth in claim 4, wherein said means for securing said connector to said adapter includes a hinged clamp engaging said adapter and said connector, said clamp having an open position when said connector is not secured to said adapter and a closed position extending completely about the axis of said adapter when said connector is secured to said adapter, said clamp pulling said connector against said igniter to compress said seal between said igniter and connector insulators and between said insulators and said clamp when in the closed position.

11. An igniter and cable connector assembly, as set forth in claim 10, wherein said adapter and said connector each have an annular conical surface segment and wherein said clamp has annular conical surface segments which engage said adapter and connector conical surface segments as said clamp is closed, said conical surface segments cooperating to pull said connector terminal against said igniter terminal and to compress said seal as said clamp is closed.

12. An igniter and cable connector assembly, as set forth in claim 11, wherein said connector includes spring means mounting said connector terminal for axial movement between first and second positions, said connector terminal moving from said first position toward said second position when said connector is secured to said adapter, and means for causing said connector terminal to rotate about its axis as it moves between said first and second positions.

13. An igniter and cable connector assembly, as set forth in claim 12, wherein said connector terminal and said igniter terminal have mating conical surfaces, and wherein at least one of said conical surfaces is a conical segment.

14. An igniter and cable connector assembly, as set forth in claim 12, wherein said connector terminal and said igniter terminal have mating spherical surfaces, and wherein at least one of said spherical surfaces is a spherical segment.

15. An igniter and cable connector assembly, as set forth in claim 1, wherein said means for securing said cable connector to said adapter includes a groove formed in an exterior surface of one of said connector and said adapter, a plurality of ball means mounted on the other of said connector and adapter for engaging said groove, and means for holding said ball means in said groove for attaching said connector and said adapter together.

16. An igniter and cable connector assembly, as set forth in claim 15, wherein said ball means comprises at least three balls, and wherein said means for holding said balls in said groove includes a sleeve mounted to move in an axial direction on said assembly between first and second positions, a spring positioned to urge said sleeve to said first position, and means on said sleeve for holding said balls in said groove when said sleeve is in said first position and for permitting said balls to retract from said groove when said sleeve is in said second position.

17. An igniter and cable connector assembly, as set forth in claim 1, and further including a first annular seal compressed between said adapter and said igniter shell head and a second annular seal compressed between said igniter shell head and said connector shell when said connector is secured to said adapter.

18. An igniter and cable connector assembly, as set forth in claim 17, and wherein said means for securing said adapter to said engine comprises external threads on said adapter located for engaging complementary threads in the engine igniter opening.

19. An igniter and cable connector assembly, as set forth in claim 17, wherein said adapter includes a flange, and wherein said means for securing said adapter to said engine comprises means for bolting said adapter flange to the engine with said adapter opening aligned with the engine igniter opening.

20. In an igniter cable connector having an insulator and a high voltage terminal mounted in said insulator, said high voltage connector terminal having an end projecting from said insulator for contacting a terminal on an igniter, a structure for mounting said terminal in said insulator characterized by means mounting said connector terminal for limited axial movement between first and second positions, a spring connected to urge said connector terminal toward said first position, said connector terminal moving from said first position toward said second position when said connector is secured to an igniter, and means causing said connector terminal to rotate about its axis as said connector terminal is moved from said first position toward said second position.

21. A structure for mounting a connector terminal in an insulator for an igniter cable connector, as set forth in claim 20, wherein said means causing said connector terminal to rotate about its axis as said connector terminal is moved from said first position toward said second position comprises at least one helical thread formed in one of said connector insulator and said connector terminal, and means on the other of said connector terminal and said connector insulator engaging said thread for causing said connector terminal to rotate as said connector terminal moves between said first and second positions.

22. In an igniter and cable connector assembly including a first high voltage terminal on an igniter and a second high voltage terminal on a cable connector, and a spring arranged in said connector to press said second terminal against said first terminal when said connector is secured to said igniter, wherein said first and second terminals characterized by one of said first and second terminals having a conical first surface area extending about an axis, and the other of said first and second terminals having an annular portion terminating at a conical segment second surface area oriented to contact said first surface area about said axis when said connector is secured to said igniter.

23. High voltage terminals for an igniter and a cable connector, as set forth in claim 22, and further including means in said connector for causing said connector terminal to rotate relative to said igniter terminal when said connector is secured to said igniter.

24. In an igniter and cable connector assembly including a first high voltage terminal on an igniter and a second high voltage terminal on a cable connector, and a spring arranged in said connector to press said second terminal against said first terminal when said connector is secured to said igniter, wherein said first and second terminals characterized by one of said first and second terminals having a convex spherical first surface area extending about an axis, and the other of said first and second terminals having an annular portion terminating at a concave spherical segment second surface area oriented to contact said first surface area about said axis when said connector is secured to said igniter.

25. High voltage terminals for an igniter and a cable connector, as set forth in claim 24, and further including means in said connector for causing said connector terminal to rotate relative to said igniter terminal when said connector is secured to said igniter.

26. An igniter comprising a shell including a tubular metal sheath having an axis, first and second ends, a smooth exterior surface extending between said first and second ends, and an enlarged diameter annular head at said second sheath end, said sheath having a diameter less than said enlarged diameter head between said first and second ends, a tubular insulator mounted coaxially in a bore through said shell, a first fused glass seal bonded between said insulator and said shell and extending completely about said axis, said insulator having an end located adjacent said second sheath end, a center electrode mounted in a bore through said insulator, a second fused glass seal bonded between said insulator and said center electrode and extending completely about said axis, said center electrode having a first end forming a spark gap with a ground electrode at said first sheath end and having a second end forming a terminal.

27. An igniter, as set forth in claim 26, wherein said terminal has a spherical contact surface.

28. An igniter, as set forth in claim 27, wherein said spherical contact surface is a spherical segment.

29. An igniter, as set forth in claim 26, wherein said terminal has a conical contact surface.

30. An igniter, as set forth in claim 29, wherein said conical contact surface is a conical segment.

31. An igniter, as set forth in claim 26, wherein said insulator end includes a head having a radial diameter greater than the maximum diameter of said sheath bore.

32. An igniter, as set forth in claim 31, and wherein said terminal projects from said insulator head end.

33. An igniter, as set forth in claim 26, and including at least one radial step in said smooth exterior sheath surface.

34. An igniter, as set forth in claim 26, wherein said insulator end includes a head which extends radially over at least a portion of said sheath head.

35. An igniter and cable connector assembly for use with an engine, comprising an igniter, means for securing said igniter to the engine, means on said igniter defining a cylindrical shell having an annular groove formed therein, an exciter cable connector, and means securing said connector to said igniter including a plurality of ball means mounted on said connector for engaging said annular groove, and means on said connector for holding said ball means in said groove for attaching said connector to said igniter.

36. An igniter and cable connector assembly, as set forth in claim 35, wherein said ball means comprises at least three balls, and wherein said means for holding said balls in said groove includes a sleeve mounted to move in an axial direction on said connector between first and second positions, a spring positioned to urge said sleeve to said first position, and means on said sleeve for holding said balls in said groove when said sleeve is in said first position and for permitting said balls to retract from said groove when said sleeve is in said second position.

* * * * *